United States Patent [19]

Dorosz

[11] 3,965,830

[45] June 29, 1976

[54] ASSEMBLY FOR AUTOMATIC BAR TACKING

[75] Inventor: Adolph Stephen Dorosz, Beverly, Mass.

[73] Assignee: USM Corporation, Boston, Mass.

[22] Filed: Dec. 5, 1974

[21] Appl. No.: 530,048

[52] U.S. Cl. ..... 112/121.11; 112/252

[51] Int. Cl.[2] ..... D05B 19/00; D05B 65/02

[58] Field of Search ..... 112/121.12, 121.11, 112/121.15, 2, 252

[56] References Cited

UNITED STATES PATENTS

| | | | |
|---|---|---|---|
| 1,404,727 | 1/1922 | Allen | 112/252 |
| 3,141,432 | 7/1964 | Reeber et al. | 112/252 |
| 3,359,933 | 12/1967 | Bono | 112/252 |
| 3,742,879 | 7/1973 | Schaefer, Jr. | 112/121.12 |

*Primary Examiner*—Werner H. Schroeder
*Assistant Examiner*—Peter Nerbun
*Attorney, Agent, or Firm*—Ralph D. Gelling; Vincent A. White; Richard B. Megley

[57] ABSTRACT

In order to convert a standard manually converted bar tacker type sewing machine to automatic numerical control an assembly is constructed which consists of a stepping motor drive system operatively connected to the work clamp positioning levers through gear sectors mounted on pivot arms. In this manner rotation of the stepping motors causes movement of the work clamp along two axes similar to the motion caused by a style cam. The style cam is therefore eliminated. Collateral functions such as nipping and thread cutting are initiated by the knife cam which is driven through a clutch by the cam shaft. In order to remove the restrictions caused by gear ratio and cam size and shape, the knife cam is engaged only for the first and last few stitches of the tack design. The control system, therefore, initiates and times the positioning of the work clamp, starting and stopping of the machine and engagement and disengagement of the knife cam.

6 Claims, 9 Drawing Figures

ASSEMBLY FOR AUTOMATIC BAR TACKING

BACKGROUND OF THE INVENTION

Bar tacking is the term used to describe the sewing of small stitch patterns which are generally used for reinforcing joints in shoes and other garments. These patterns are generally limited to a specific number of stitches in the range of from 10 to 100 stitches per pattern and cover only a small area of the workpiece. The operation is performed by moving the workpiece under the needle and this motion is achieved automatically by means of a work clamp which is mounted for movement along two axes relative to the needle. Work clamp movement is controlled by a style or feed cam which is operatively linked to the clamp. The style cam is generally driven by means of a shaft connected to the main needle bar drive shaft through a gear train. Thread cutting is controlled by a second cam connected to the same shaft but mounted opposite to the style cam. In this manner a limited amount of automatic operation is achieved. However, the variety of patterns are limited by cam design and the gear ratio between the needle drive shaft and the cam shaft since each pattern must be completed within one rotation of the cam. This necessitates the replacement of the style cam for each change in pattern and in addition, if the number of stitches in the pattern changes, a new gear train must be installed. This may require anywhere from two to as long as eight hours effort by a skilled mechanic and results in a significant loss of production per machine.

The purpose of this invention, therefore, is to provide an automatic bar tacker which is free of the restrictions of the style cam, thereby eliminating the need for costly changes resulting in loss of production. This is achieved by the replacement of the style cam with a numerically controlled drive. The subject invention is intended to be easily installed on existing machines with as little modification of the sewing machine as possible

BRIEF DESCRIPTION OF THE INVENTION

In order to convert the standard bar tacker sewing machine to numerical control, the style and knife cams are removed from their shaft. The knife cam is replaced by a new cam which is operatively connected to its shaft through a clutch. The new cam is constructed with additional notches to provide nipper operation as well as knife positioning. The vertical operating levers formerly engaging the style cam are fitted with gear sectors and each is operatively connected to a stepping motor which is mounted on the sewing machine housing. The stepping motors therefore directly replace the style cam. The stepping motors are controlled by a numerical control system which can be programmed to cause movement of the workpiece clamp through the desired tack design.

DESCRIPTION OF THE DRAWING

This invention is more fully described in conjunction with the appended drawing and in said drawing.

DETAILED DESCRIPTION OF THE INVENTION

Prior Art

The function of bar tacking is generally performed on a standard type sewing machine which is adapted to the purpose by the addition of a work clamp for holding and moving the workpiece through the tack pattern. This movement is accomplished automatically by means of a style cam operatively connected to the work clamp and the needle drive. The patterns which are sewn are predominantly for reinforcing purposes and cover only a small surface area of the workpiece. The overall movement and the number of stitches required is, therefore, limited.

Figure 1:
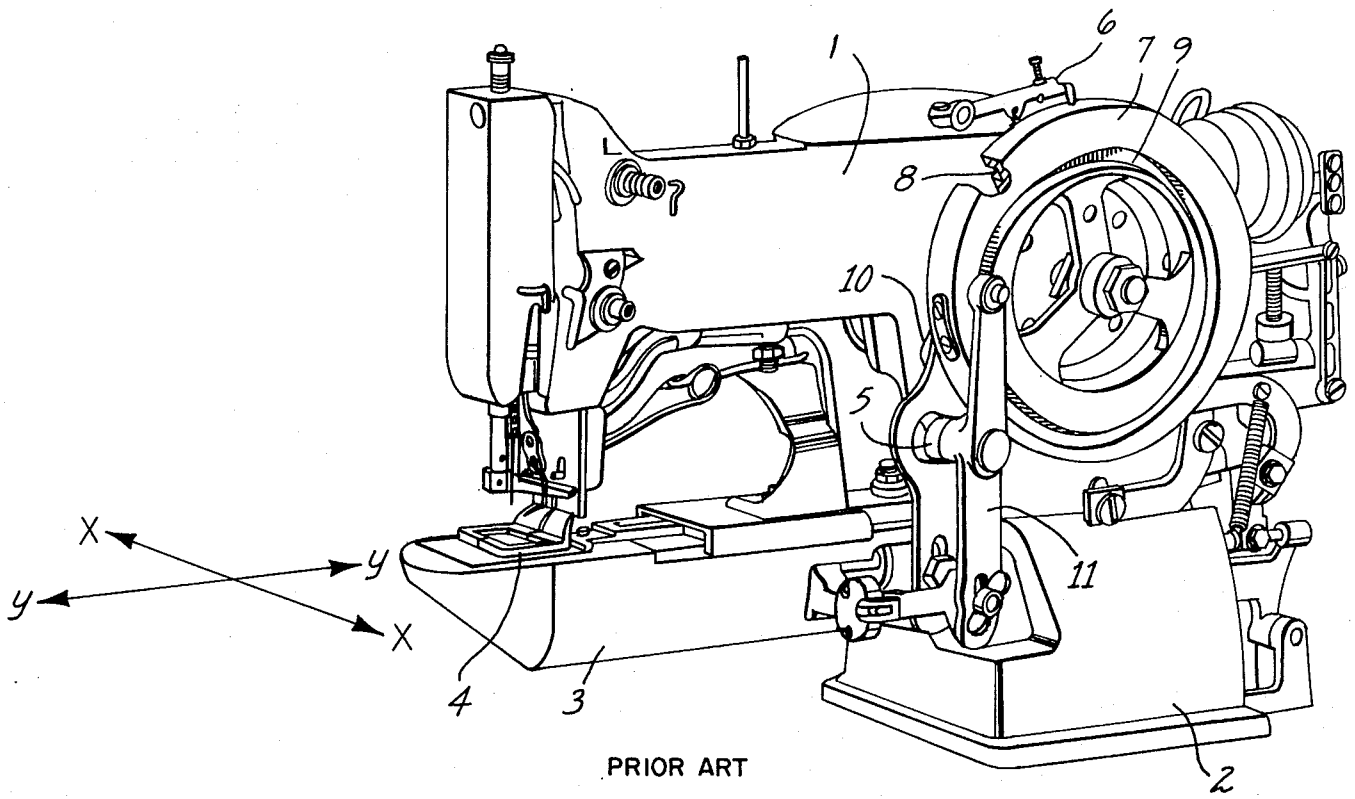
FIG. 1 is a perspective view of a standard bar tacker sewing machine showing the style cam of the prior art.

With reference to FIG. 1 the bar tacker sewing machine of the prior art is provided with a housing 1 mounted on a base 2. The housing 1 encloses a drive shaft, a cam shaft, a gear train connecting the drive and cam shafts as well as the needle bar drive linkages. Extending outward from base 2 under housing 1 is cylinder bed 3 which contains the feed mechanism for moving the workpiece clamp 4. The feed mechanism is linked to the two armed lever assembly 5.

In the prior art machine the principal motions for the complete bar tack operation are derived from two cams, which are mounted on either side of the housing on a transverse cam shaft geared to the needle drive shaft. The feed movement is along the axis X and Y as shown in FIG. 1 and this motion originates in the feed or style cam 7. The cam 7 has inside and outside tracks 8 and 9 of which track 8 controls lengthwise motion Y and track 9 controls transverse motion X through vertical two amed levers 10 and 11 respectively.

In order to insure continuous engagement between thread and needle. style cam 7 is also provided with means to actuate a nipper lever 6 which in turn operates a nipper which holds the thread tightly against the needle bar, and prevents thread pullout during start up and thread cutting. The knife cam of the prior art (not shown in FIG. 1) is located on the cam shaft on the opposite side of housing 1 from style cam 7 and provides the timing and movement for two functions, namely thread cutting and workpiece release.

The prior art machine is controlled by two foot actuated treadles mechanically connected to the sewing machine. One treadle starts and stops machine operation while the second treadle operates the thread cutting stroke. All other movements are provided by either the style cam or the knife cam both of which rotate in timed relation with needle reciprocation.

The Preferred Embodiment

Figure 2:
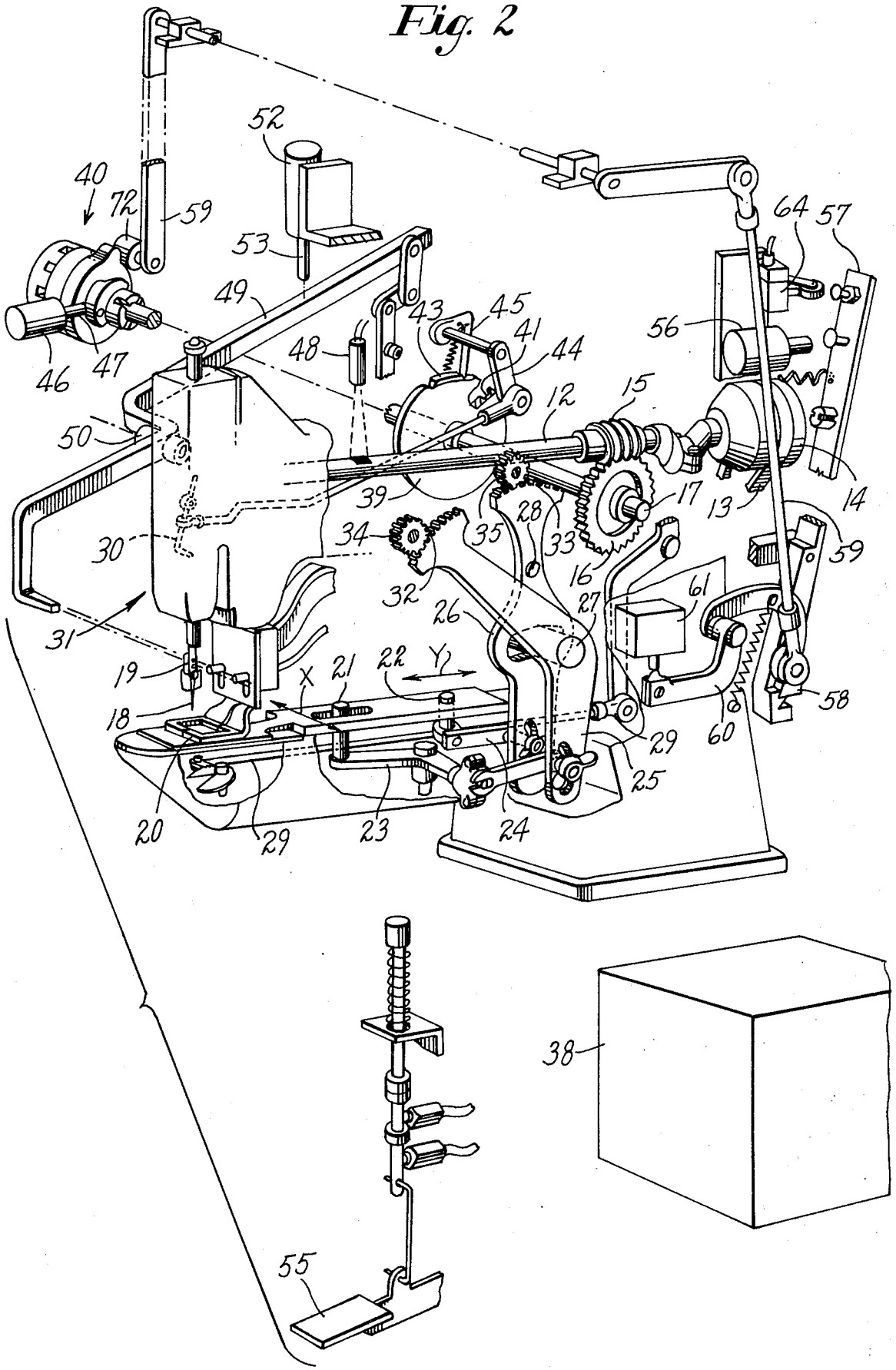
FIG. 2 is a schematic diagram of the invention.

The bar tacker sewing machine of this invention is shown in schematic form in FIG. 2. It employs the standard mechanisms, namely, a needle bar drive shaft 12 which is connected to a drive motor (not shown)

through belt 13 and clutch 14. Worm gear 15 mounted on the drive shaft 12 engages gear 16 secured to a transverse cam shaft 17. Needle 18 is secured to needle bar 19 which reciprocates during machine operation. A work clamp 20 is provided which is mounted for pivotal and sliding movement on the machine. Linkages 23 and 24 connect the work clamp 20 to operation levers 25 and 26 respectively. As shown, lever 25 is connected to work clamp 20 at point 21 and movement thereof causes movement of the work clamp along the X axis, while lever 26 is connected to clamp 20 at point 22 and movement thereof causes movement of the work clamp along the Y axis. The operation levers 25 and 26 are mounted for pivotal movement at points 27 and 28 respectively. A knife mechanism 29 is provided for cutting the thread and a nipper bar 30 is mounted in the sewing head 31 to hold the thread during cutting and during the initial part of the stitching operation to prevent the thread from pulling out of the needle.

Figure 3:
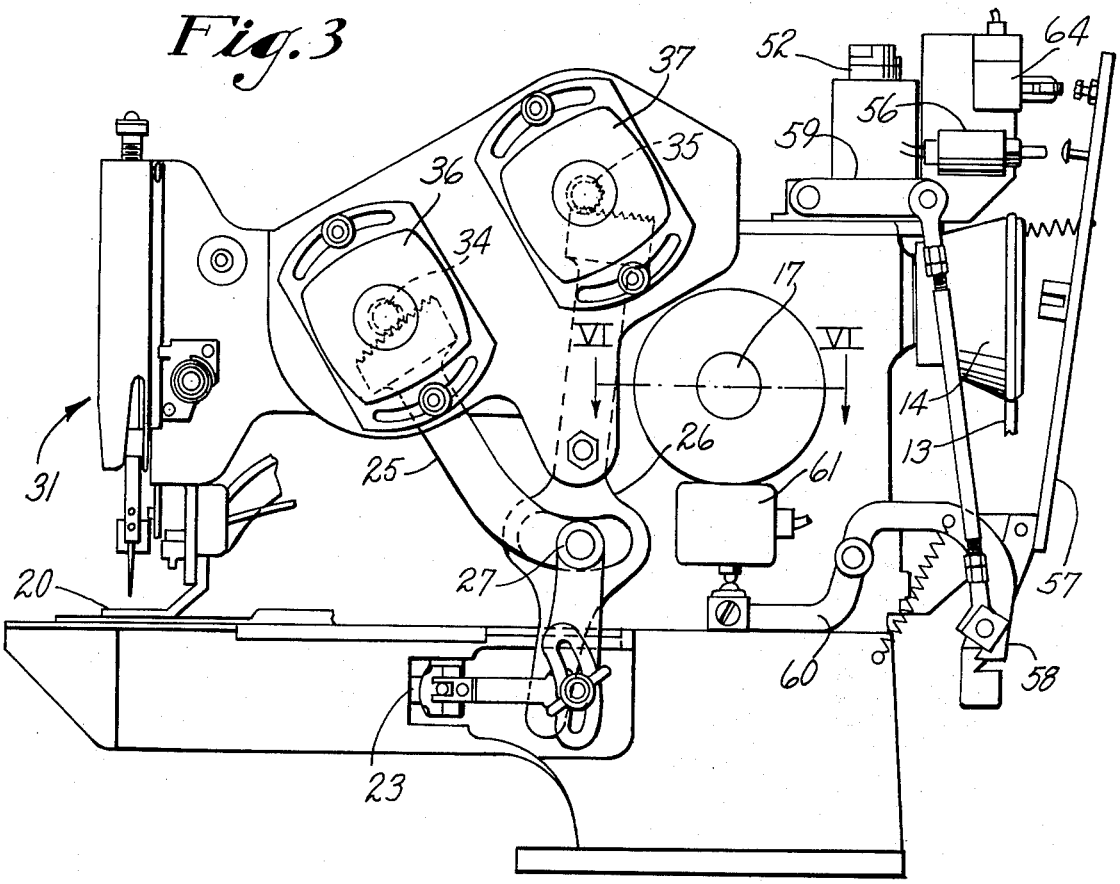
FIG. 3 is a side view of a bar tacker sewing machine according to the invention.

In order to provide motion for the work clamp 20, the operation levers 25 and 26 have gear sectors 32 and 33 fixed to the upper end of the lever arms. The gear sectors 32 and 33 mesh with pattern drive gears 34 and 35. The gears 34 and 35 are driven by stepping motors 36 and 37 as shown in FIG. 3. Each of the stepping motors is constructed to respond with a specific degree of rotary motion for each drive pulse it receives. In order to generate the drive signal, a digital control 38 is provided which may be programmed to generate the pulses necessary to cause movement of the workpiece through a predetermined tack pattern. The programmed instruction may be in the form of a PROM (Programmable Read Only MEMORY) which may be inserted into circuitry of control 38 to cause generation of the pulses necessary for the desired pattern. To obtain different patterns, all that is needed is to change to a different PROM.

Figure 4:
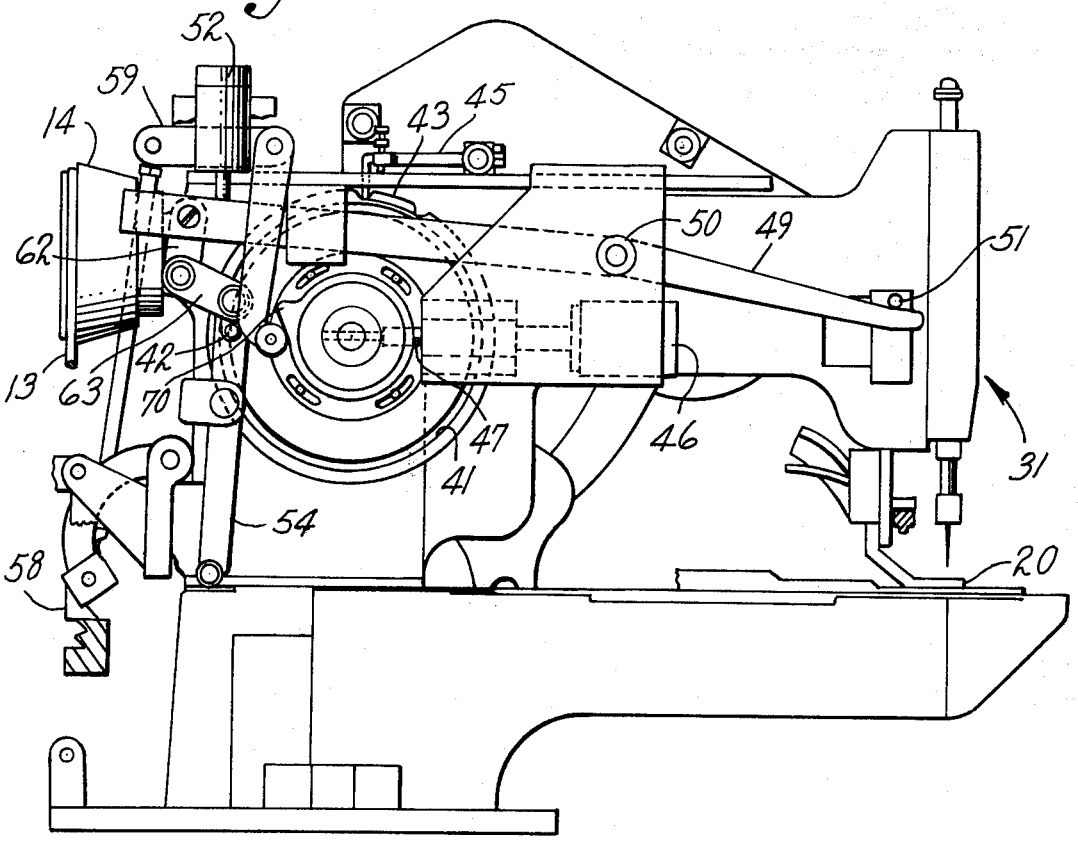
FIG. 4 is a side view of the knife cam side of a bar tacker sewing machine incorporating this invention.

A knife cam 39 is mounted for free rotation on cam shaft 17, and is releasably coupled to shaft 17 through clutch 40. When clutch 40 is engaged, the cam 39 turns with the cam shaft 17 which is in turn driven by drive shaft 12 through gears 15 and 16. As shown in FIG. 4, the knife cam 39 is constructed with a track 41 which receives a follower 42 connected to the cutting mechanism 29 through follower arm 54. The rotating knife cam 39, therefore, provides motion for the positioning of cutting mechanism 29 according to a design which is well known in the art. The actual cutting stroke is provided by air cylinder 52 as described below. By adjusting the ratio between worm gear 15 and gear 16, the complete cutting operation may be performed within the period of a few stitches and at other times the cam may be at rest through disengagement of clutch 40. The absence of the style cam and the clutching of the knife cam eliminate the restrictions formerly limiting the number of stitches which could be performed in a tack pattern because the pattern and the cutting operation need no longer be completed within one revolution of the cams.

Operation of nipper bar 30 may also be provided by knife cam 39 through an additional cam surface 43 on the circumference of knife cam 39. To accomplish this, the bar 30 is connected through linkage 44 to follower 45 in a known manner as shown in FIG. 5.

In order to operate clutch 40, a solenoid 46 is mounted on the sewing machine and has a shaft 47 extending therefrom. The shaft 47 moves from a withdrawn position to an extended position upon energization of the solenoid. In the extended position, the shaft 47 engages a surface of the clutch causing release of the clutch 40 and locking of the cam 39. The solenoid 46 may be energized by a signal from control 38 which can be programmed to occur at any desirable point in the stitch cycle. As shown in the timing diagram of FIG. 8, in the preferred embodiment, the clutch is disengaged after the fifth stitch and engaged again before the third stitch from the end of the cycle.

Figure 5:
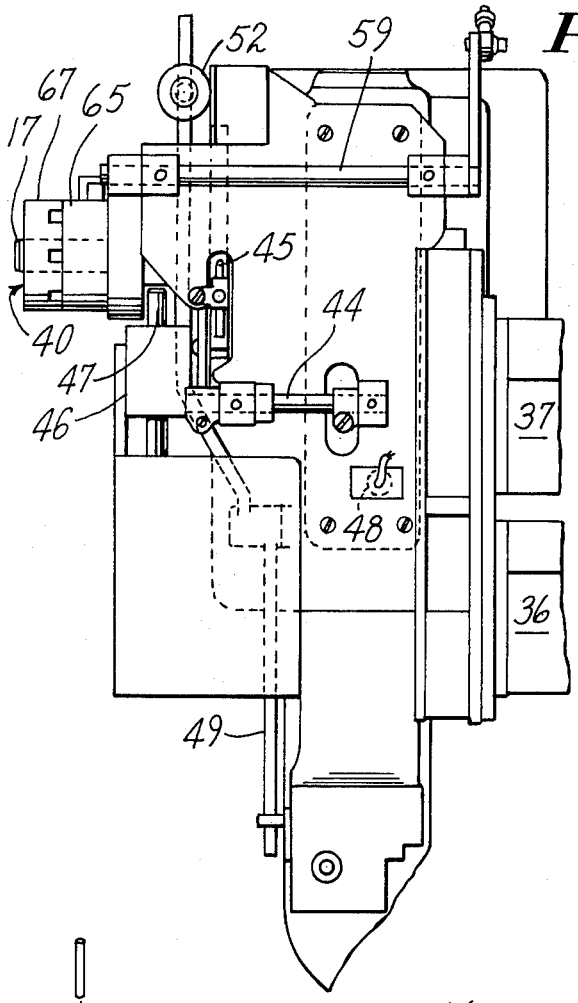
FIG. 5 is a top view of a bar tacker sewing machine incorporating the invention.
Figure 6:
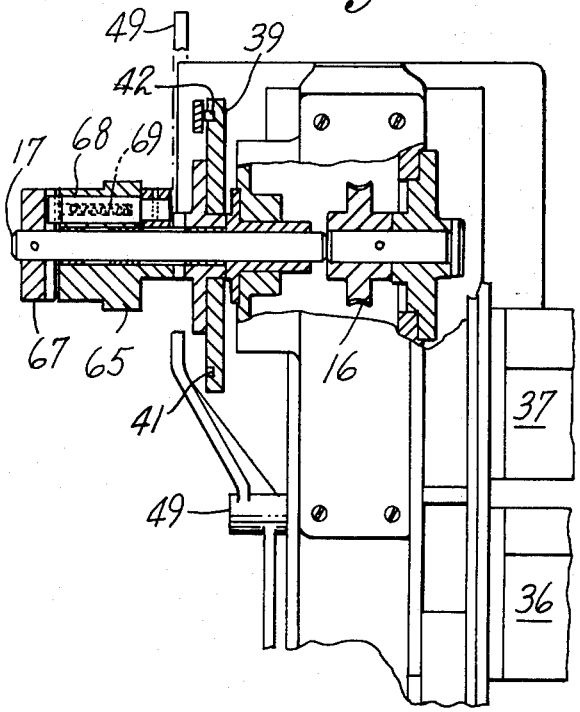
FIG. 6 is a top view of a bar tacker sewing machine incorporating the invention with housing cut away to show the cam shaft.
Figure 7:
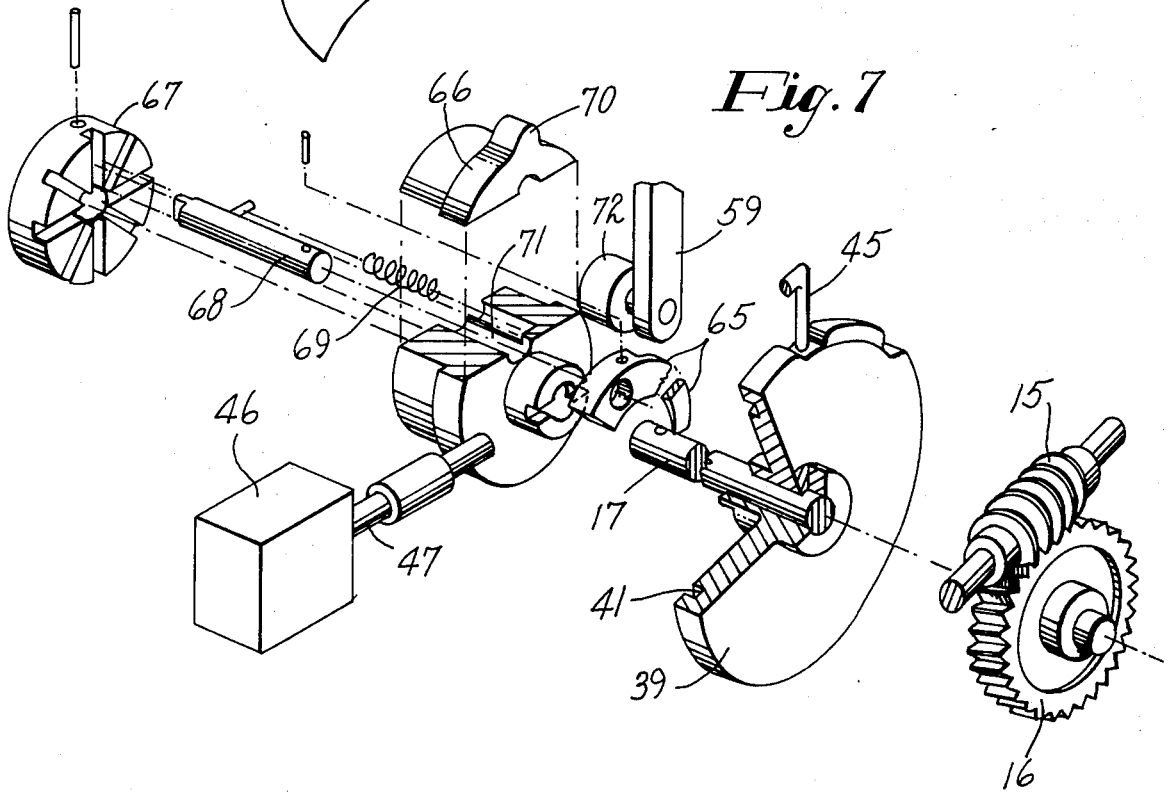
FIG. 7 is an exploded perspective view of a clutch as used in the preferred embodiment.

Clutch 40 is best shown in FIG. 7 and consists of a collar 66 coupled to knife cam 39 and mounted for free rotation on cam shaft 17 (see FIG. 5 and 6). A locking pin 68 slides in bore 71 and is spring biased away from cam 39 by spring 69. Notched hub 67 is fixed to cam shaft 17 and receives pin 68 in locking engagement when pin 68 is in its extended position. Pin 68 extends through bore 71 and is fixed to cam surface 65. In operation to release the clutch, solenoid 46 is energized extending shaft 47. Shaft 47 engages cam surface 65 and forces surface 65 away from collar 66, thereby withdrawing locking pin 68 from engagement with the notches of hub 67.

In order to allow the control 38 to keep track of the number of stitches performed during a specific tack pattern, a magnetic pulse generator 48 is provided which sends a timing pulse to the control 38 for each rotation of drive shaft 12. This may be accomplished simply by mounting a magnetic element on shaft 12 and placing a magnetic sensing head on the machine housing. A pulse is induced in the sensing head for each passing of the magnet.

At the end of the stitching operation, it is desirable to cut the thread and release the workpiece from its clamp. To provide this function, a lever arm 49 is pivotally mounted on the sewing machine at point 50. As best shown in FIG. 4, the forward end of lever arm 49 engages a lifting mechanism 51 in the sewing head 31. The mechanism 51 causes the jaws of the work clamp 20 to separate as the forward end of lever arm 49 pivots upward. This upward movement is caused by air cylinder 52, the piston rod 53 of which engages the rear end of lever arm 49. When the piston rod 53 extends upon actuation of the cylinder 52, the lever arm 49 pivots to open the jaws of the work clamp 20. The rearward end of lever arm 49 is linked by pivotal members 62 and 63 to follower arm 54 which in turn is connected to the knife mechanism 29. The downward motion of the rear end of lever 49 caused by extension of piston rod 53 actuates the cutting stroke of the knife.

OPERATION

Operation of the machine is started by the manual depression of a treadle 55 which actuates air cylinder 56 and forces lever 57 to pivot away from the machine thereby engaging ratchet 58 to lock in this position. This motion simultaneously causes the engagement of drive shaft 12 to the drive motor through clutch 14 and actuates air valve 64 to cause retraction of piston rod 53 to clamp the workpiece. Engagement of ratchet 58 causes lever 60 to rotate, thereby actuating microswitch 61. The switch 61 in turn energizes control 38. As soon as control 38 receives timing pulses from pulse generator 48, it begins to send its programmed signals to stepping motors 36 and 37, thereby causing movement of the workpiece according to the predetermined pattern. At the end of the fifth stitch, control 38 generates a signal which actuates solenoid 46 to disengage clutch 40 and lock cam 39 against rotation. Cam 39, therefore, does not rotate during the major portion of the tack pattern and is only engaged again at the beginning of the third stitch from the end of the pattern.

Figure 8:
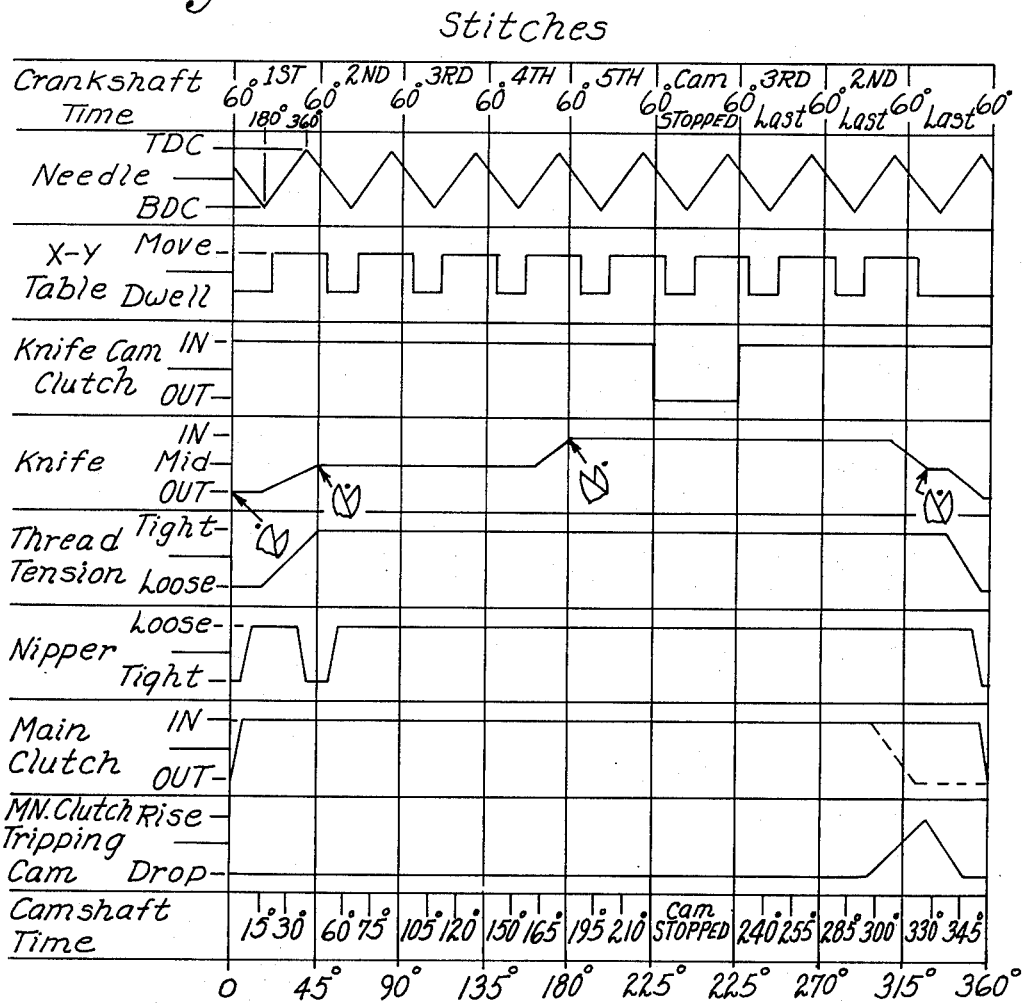
FIG. 8 is a timing diagram of the functioning of the machine.
Figure 9:
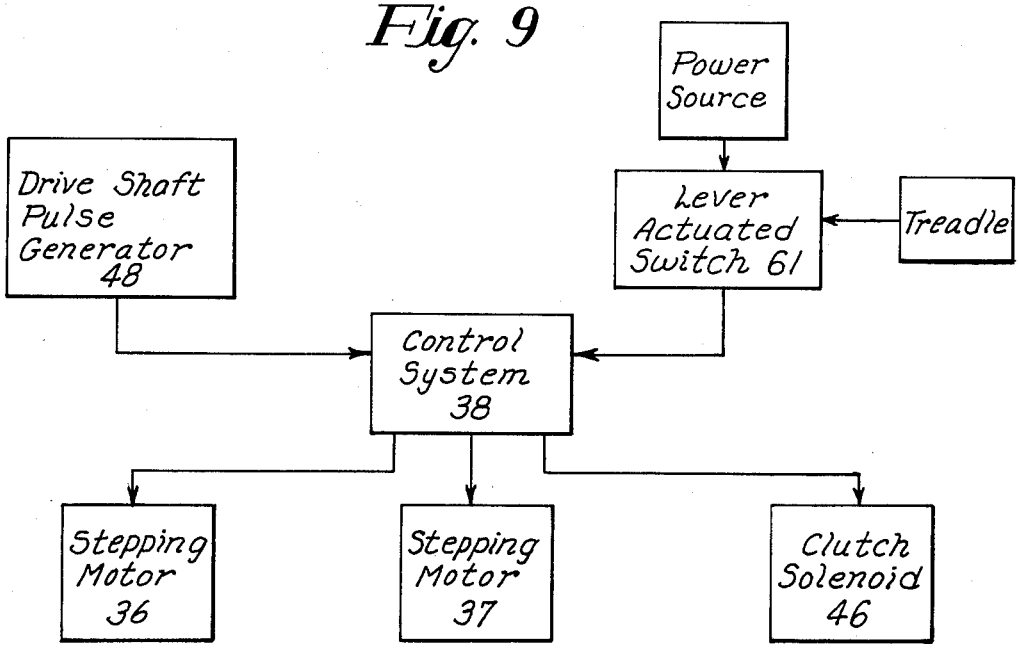
FIG. 9 is a block diagram showing the flow of information to and from the control system.

At the end of the tack pattern, the knife cam will have rotated a full turn thereby causing the knife position to move as indicated in FIG. 8 placing the knife in position for the cutting stroke. Again referring to FIG. 8, it is observed that the nipper bar is also actuated at the end of the cycle and this is timed by knife cam 39. In order to stop the machine and initiate the cutting stroke, a lobe 70 is constructed on clutch collar 66 for engagement with a follower 72 which transmits motion to lever system 59. As the follower 72 rides over lobe 70, lever system 59 releases the ratchet 58 causing lever 57 to return thereby disengaging main drive clutch 14. Release of ratchet 58 also causes lever 60 to deactuate switch 61 which shuts off control system 38. The return of lever 57 also causes valve 58 to actuate air cylinder 52 which initiates the cutting stroke.

Having thus described my invention, and what I claim as new and desire to secure as Letters Patent of the United States is:

1. In a bar tacking sewing machine having a needle bar drive shaft operatively connected through a clutch to a motor to provide reciprocating motion to a needle, a workpiece clamp constructed to releasably secure and support a workpiece under the needle said clamp being slidably and pivotably mounted on the sewing machine for movement relative to the needle along first and second axes, means for feeding thread to the needle including a nipper for releasably engaging the thread and a knife for engaging and cutting the thread when the sewing operation is completed, the improvement comprising:

A. a first stepping motor for generating motion along the first axis of the work clamp;

B. a second stepping motor for generating motion along the second axis of the work clamp;

C. a first sequence of pivoting levers operatively connecting the first stepping motor to the workpiece clamp to convert the rotary motion of said stepping motor to translatory motion along the first axis and transmit said motion to said clamp;

D. a second sequence of pivoting levers operatively connecting the second stepping motor to the workpiece clamp to convert the rotary motion of said stepping motor to translatory motion along the second axis and transmit said motion to said clamp; and E. electronic control means for sending signals to the stepping motors to initiate rotation thereof, said rotation resulting in movement of the workpiece clamp through a predetermined pattern in timed relation to the reciprocation of the needle to form stitches in the workpiece according to said pattern.

2. In a bar tacking sewing machine having a needle bar drive shaft operatively connected through a clutch to a motor to provide reciprocating motion to a needle, a workpiece clamp constructed to releasably secure and support a workpiece under the needle said clamp being slidably and pivotably mounted on the sewing machine for movement relative to the needle along first and second axes, means for feeding thread to the needle including a nipper for releasably engaging the thread and a knife for engaging and cutting the thread when the sewing operation is completed, the improvement as described in claim 1 wherein:

a. each of the first and second stepping motors are provided with a gear mounted on the respective motor shaft for rotation therewith; and b. the first and second lever sequences are each operatively connected to the stepping motors by engagement with the respective motor gear through a gear sector fixed to a lever arm pivotally mounted on the sewing machine, in a manner which causes pivoting of each lever arm in response to rotation of the respective motor.

3. In a bar tacking sewing machine having a needle bar drive shaft operatively connected through a clutch to a motor to provide reciprocating motion to a needle, a workpiece clamp constructed to releasably secure and support a workpiece under the needle said clamp being slidably and pivotably mounted on the sewing machine for movement relative to the needle along first and second axes, means for feeding thread to the needle including a nipper for releasably engaging the thread and a knife for engaging and cutting the thread when the sewing operation is completed, the improvement as described in claim 1 further comprising:

a. a cam shaft rotatably mounted on the sewing machine transverse to the needle bar drive shaft and being operatively geared to said drive shaft for coordinated rotation therewith;

b. a cam mounted for free rotation on the cam shaft and having a cam slot constructed therein to provide movement for the thread cutting knife;

c. an electrically operated clutch fixed to the cam shaft and releasably engaging the cam to cause rotation of said cam on said shaft during selected portions of the sewing operation;

d. linkage means connected to the thread cutting knife and to the cam slot through a follower to cause movement of said knife according to the configuration of the slot; and e. electronic control means for actuating the clutch to cause engagement of the cam to the cam shaft only during the initial and final portions of the sewing operation.

4. In a bar tacking sewing machine having a needle bar drive shaft operatively connected through a clutch to a motor to provide reciprocating motion to a needle, a workpiece clamp constructed to releasably secure and support a workpiece under the needle said clamp being slidably and pivotably mounted on the sewing machine for movement relative to the needle along first and second axes, means for feeding thread to the needle including a nipper for releasably engaging the thread and a knife for engaging and cutting the thread when the sewing operation is completed, the improvement as described in claim 3 wherein the cam has a second cam surface for providing movement for the nipper and further comprising a second linkage connected to the nipper and to said second cam surface through a follower to cause movement of the nipper acccording to the configuration of said cam surface.

5. In a bar tacking sewing machine having a needle bar drive shaft operatively connected through a clutch to a motor to provide reciprocating motion to a needle, a workpiece clamp constructed to releasably secure and support a workpiece under the needle said clamp being slidably and pivotably mounted on the sewing machine for movement relative to the needle along first and second axes, means for feeding thread to the needle including a nipper for releasably engaging the thread and a knife for engaging and cutting the thread when the sewing operation is completed, the improvement comprising:

a. a cam shaft rotatably mounted on the sewing machine transverse to the needle bar drive shaft and being operatively geared to said drive shaft for coordinated rotation therewith;

b. a cam mounted for free rotation on the cam shaft and having a cam slot constructed therein to provide movement for the thread cutting knife;

c. an electrically operated clutch fixed to the cam shaft and releasably engaging the cam to cause rotation of said cam on said shaft during selected portions of the sewing operation;

d. linkage means connected to the thread cutting knife and to the cam slot through a follower to cause movement of said knife according to the configuration of the slot; and e. electronic control means for actuating the clutch to cause engagement of the cam to the cam shaft only during the initial and final portions of the sewing operation.

6. In a bar tacking sewing machine having a needle bar drive shaft operatively connected through a clutch to a motor to provide reciprocating motion to a needle, a workpiece clamp constructed to releasably secure and support a workpiece under the needle said clamp being slidably and pivotably mounted on the sewing machine for movement relative to the needle along first and second axes, means for feeding thread to the needle including a nipper for releasably engaging the thread and a knife for engaging and cutting the thread when the sewing operation is completed, the improvement as described in claim 5 wherein the cam has a second cam surface for providing movement for the nipper and further comprising a second linkage connected to the nipper and to said second cam surface through a follower to cause movement of the nipper according to the configuration of said cam surface.

* * * * *